US010337157B2

(12) United States Patent
Baez et al.

(10) Patent No.: US 10,337,157 B2
(45) Date of Patent: Jul. 2, 2019

(54) COLD AIR BLOWER WITH SELF-SUPPORTED BOOM

(71) Applicant: Wausau Equipment Company, Inc., New Berlin, WI (US)

(72) Inventors: Hector E. Baez, Fond du Lac, WI (US); Neil L. Pelishek, Oshkosh, WI (US); Joshua M. Heinz, Fond du Lac, WI (US)

(73) Assignee: Wausau Equipment Company, Inc., New Berlin, WI (US)

( * ) Notice: Subject to any disclaimer, the term of this patent is extended or adjusted under 35 U.S.C. 154(b) by 271 days.

(21) Appl. No.: 15/279,642

(22) Filed: Sep. 29, 2016

(65) Prior Publication Data

US 2017/0096787 A1 Apr. 6, 2017

Related U.S. Application Data

(60) Provisional application No. 62/236,500, filed on Oct. 2, 2015.

(51) Int. Cl.

| | |
|---|---|
| ***E01H 1/08*** | (2006.01) |
| ***F04D 29/28*** | (2006.01) |
| ***F04D 29/32*** | (2006.01) |
| ***F04D 29/40*** | (2006.01) |

(52) U.S. Cl.

CPC ..... *E01H 1/0809* (2013.01); *F04D 29/281* (2013.01); *F04D 29/325* (2013.01); *F04D 29/403* (2013.01)

(58) Field of Classification Search

CPC ... E01H 1/0809; F04D 29/281; F04D 29/325; F04D 29/403

See application file for complete search history.

(56) References Cited

U.S. PATENT DOCUMENTS

| | | | | |
|---|---|---|---|---|
| 3,348,258 | A * | 10/1967 | Daneman | E01H 1/0836 15/314 |
| 2002/0157212 | A1* | 10/2002 | Velinsky | E01H 1/0827 15/414 |
| 2011/0296646 | A1* | 12/2011 | Showley | E02F 3/8825 15/327.1 |
| 2013/0305482 | A1* | 11/2013 | Crockett | E01H 1/0836 15/340.1 |

(Continued)

*Primary Examiner* — Marc Carlson

(74) *Attorney, Agent, or Firm* — Andrus Intellectual Property Law, LLP

(57) ABSTRACT

A cold air blower for removing debris from a ground surface that includes a boom rotatable between multiple operating positions and a stowed position. The boom is mounted to a power unit mounted to the vehicle chassis such that the boom is rotatable between at least a front-facing, operating position and a rear-facing stowed position. The boom includes a top tube and a discharge tube that includes a discharge nozzle. The combination of the top tube and the discharge tube are rotatable about the power unit such that the discharge tube is positioned behind the midpoint of the vehicle chassis in the stowed position. The nozzle on the discharge tube can be operated to automatically and continuously rotate between a first pan position and a second pan position. The boom can be rotated between opposite first and second side positions that extend perpendicular to the vehicle axis in opposite directions.

15 Claims, 13 Drawing Sheets

(56) References Cited

U.S. PATENT DOCUMENTS

2014/0220879 A1* 8/2014 Krueger ..... E01H 1/0809
454/305
2015/0354156 A1* 12/2015 Krueger ..... E01H 1/0809
15/405

* cited by examiner

COLD AIR BLOWER WITH SELF-SUPPORTED BOOM

CROSS-REFERENCE TO RELATED APPLICATION

The present application is based on and claims priority from U.S. Provisional Patent Application Ser. No. 62/236,500, filed on Oct. 2, 2015, the disclosure of which is incorporated herein by reference.

BACKGROUND

The present disclosure generally relates to a cold air blower. More specifically, the present disclosure relates to a cold air blower that has a self-supported boom that does not require support of the boom along a track in front of the vehicle, which allows the boom to be rotated between at least one front facing operating position and a rear facing stowed position.

Presently, different types of cold air blowers are available to direct a flow of high velocity air to clean debris or snow off of a paved surface or railway tracks. In currently available systems, a boom extends from a source of high velocity air to a nozzle. The weight of the boom is supported on a track mounted to and extending in front of a bumper in front of the vehicle. The support of the boom in such a manner results in a vertical discharge tube of the boom being positioned in front of the vehicle cab at all times. This location of the vertical tube restricts the view of the operator when the cold air blower is used on roadways or during transport.

Therefore, a need exists for a cold air blower in which the boom can be moved from a front, operating position to a rear, stowed position. Further, a need exists for a cold air blower that includes the ability to rotate the boom into additional operating positions to enhance the functions and possible uses of the cold air blower.

SUMMARY

The present disclosure generally relates to a cold air blower that includes a self-supported boom. More specifically, the present disclosure relates to a cold air blower that includes a boom that can be moved between multiple operating positions and a stowed position in which the vertical discharge tube of the boom is out of view of the vehicle operator.

The cold air blower of the present disclosure includes a vehicle chassis that has a front end and a rear end such that the vehicle chassis extends along a vehicle axis. Typically, an operator will be located within a cab of the cold air blower near the front end of the vehicle chassis. The cold air blower includes a power unit that is mounted to the vehicle chassis and includes at least a blower that is operable to generate an airflow used to remove debris from the ground. The blower is driven by some type of power generating device, such as an internal combustion engine. The blower generates an airflow that is used by the cold air blower to remove debris from a ground surface.

The cold air blower includes a boom that is mounted to the vehicle chassis and receives the airflow from the blower. The boom directs the airflow from the blower through a nozzle that is positioned to direct the airflow onto the ground surface. In one embodiment of the disclosure, the boom includes a generally horizontal top tube that is joined to a generally vertical discharge tube. The generally vertical discharge tube includes the nozzle.

In one embodiment of the disclosure, the boom is self-supported such that the boom can be rotated between multiple operating positions and a stowed position. In the first operating position, the top tube of the boom extends generally parallel to the vehicle axis such that the nozzle is located forward of the front end of the vehicle chassis. In this position, the nozzle is able to direct the airflow in front of the vehicle to clear debris from a ground surface in front of the vehicle. The boom can be rotated to a rear, stowed position in which the boom is positioned at an angle relative to the vehicle axis. In the stowed position, the nozzle is positioned behind a midpoint of the vehicle chassis, where the midpoint is defined as a midpoint between the front and rear ends of the vehicle. In the stowed position, the vertical discharge tube is also located behind the midpoint of the vehicle chassis and out of the way of the cab.

The boom is mounted to a turret which allows the boom to rotate between the multiple operating positions and the stowed position. Two of the contemplated operating positions include operating positions in which the boom extends in opposite perpendicular directions relative to the vehicle axis. In one embodiment, an elbow having an open flow passageway connects the top tube of the boom to the turret and allows the airflow to travel from the blower into the top tube. The turret allows the boom to rotate into at least a first side operating position and a second side operating position, wherein the first and second side operating positions are perpendicular in opposite directions from the vehicle axis.

In accordance with another aspect of the present disclosure, the vertical length of the discharge tube is adjustable to allow the distance between the nozzle and the ground surface to be modified by an operator. The vertical adjustment is controlled by at least one drive cylinder and one or more guide rods.

In accordance with another aspect of the present disclosure, the cold air blower includes an airflow diverter that is positioned between the blower and the nozzle. The airflow diverter is operable between at least a first position in which the airflow is allowed to reach the nozzle from the blower and a second position in which the airflow is prevented from reaching the nozzle. The airflow diverter includes a valve plate mounted within the open flow passageway of the elbow and a cover plate that is mounted to an outer wall of the elbow. When the flow diverter is in the first position, the cover plate is closed and the valve plate allows the airflow to pass from the top tube and into the discharge tube. In the second position, the cover plate is in an extended position and the valve plate rotates to a blocking position to prevent the airflow from entering into the discharge tube such that the airflow is vented from the top tube.

The cold air blower of the present disclosure can further include a control system that is operable to automatically and continuously rotate the nozzle about a vertical rotation axis extending through the vertical discharge tube of the boom. The control system is thus able to automatically and continuously rotate the nozzle between a first pan position and a second pan position. The rotation between the first pan position and the second pan position can be at least 200° relative to vertical rotation axis. In this manner, an operator is able to set the control system into a pan mode such that the operator does not need to continuously rotate the nozzle manually.

BRIEF DESCRIPTION OF THE DRAWINGS

The drawings illustrate the best mode presently contemplated of carrying out the disclosure. In the drawings.

DETAILED DESCRIPTION

Figure 1:
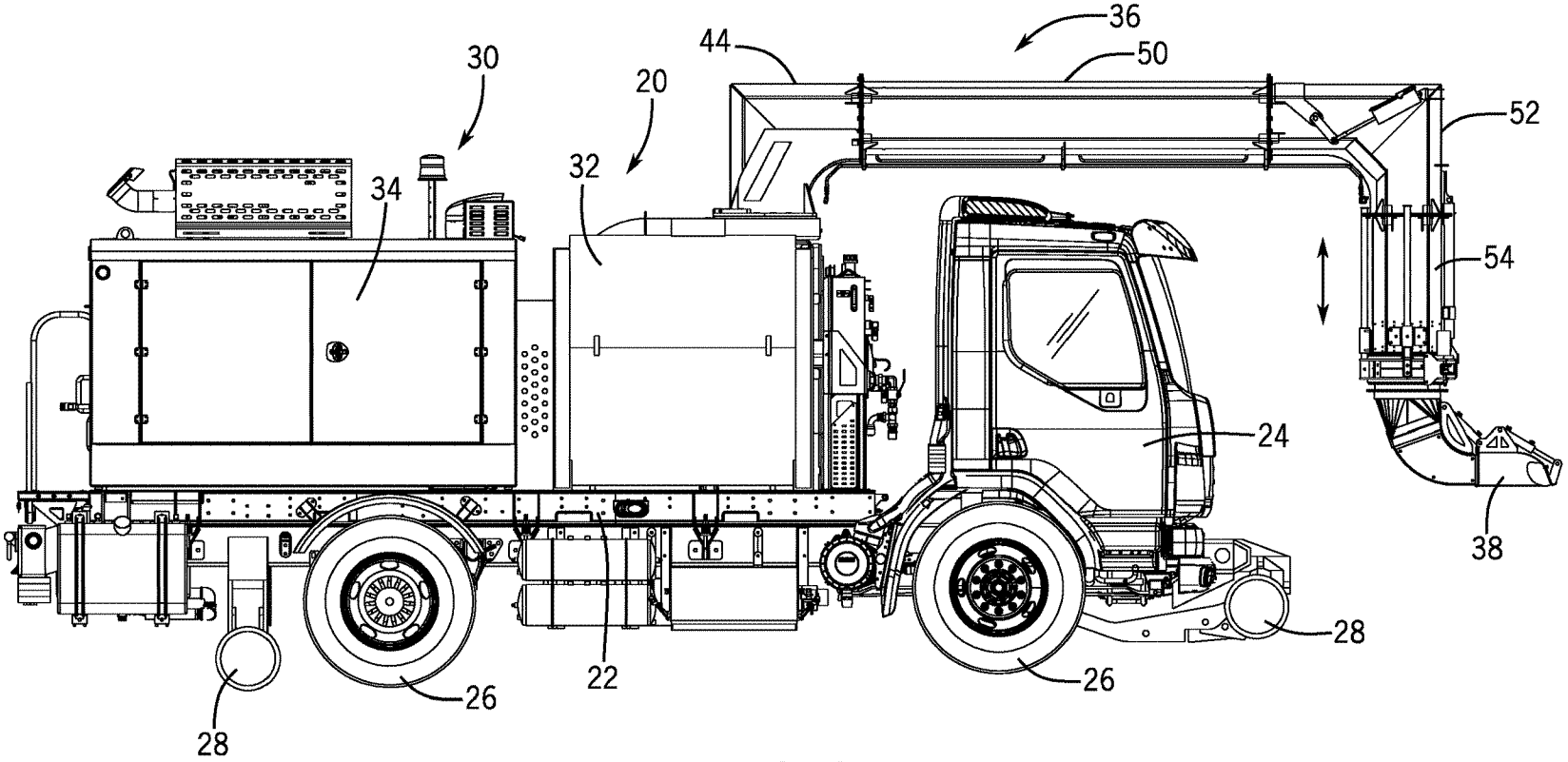
FIG. 1 is a side view of a cold air blower incorporating a self-supported boom of the present disclosure in a front facing, operative position.

FIG. 1 illustrates a cold air blower 20 constructed in accordance with the present disclosure. The cold air blower 20 is designed to remove ice pack, snow, water and other debris from an airfield or a rail system. The cold air blower 20 includes a vehicle chassis 22 that includes a cab 24 that houses an occupant during use of the cold air blower 20. The chassis 22 includes wheels 26 to support the chassis during operation on pavement. In addition, the cold air blower 20 may include retractable rail wheels 28 that can be used to support the chassis when the chassis is used on rails.

The cold air blower 20 includes a power unit 30 that includes a drive engine 34 that provides the motive force for a blower 32. In the embodiment illustrated, the drive engine 34 is a diesel engine that rotates an internal fan (not shown) housed within the blower 32. In the embodiment illustrated, both the drive engine 34 and the blower 32 are mounted to a common platform such that the entire power unit 30 can be removed from the vehicle chassis 22 and installed as a complete unit.

Figure 2:
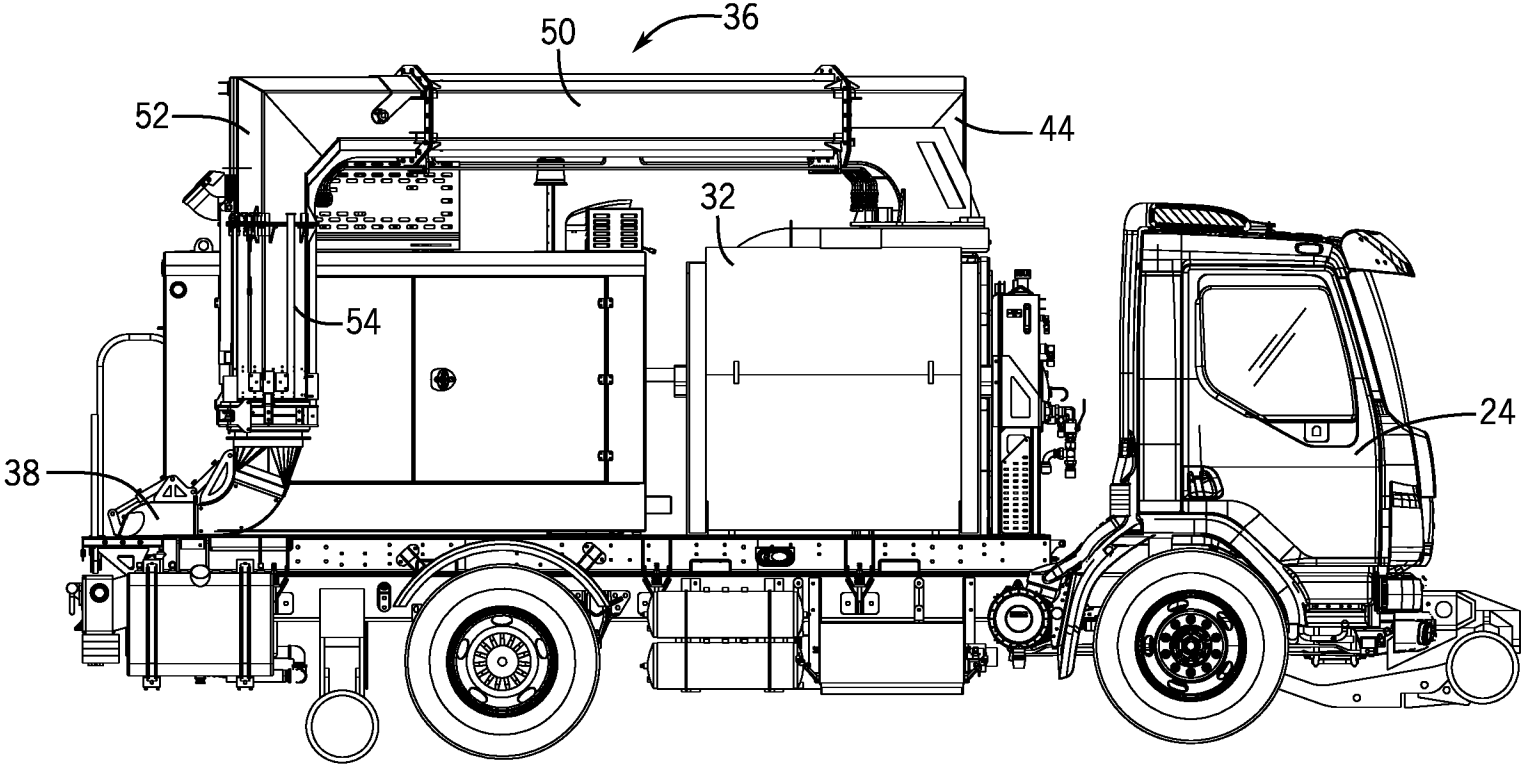
FIG. 2 is a side view of the cold air blower with the self-supported boom in a stowed, travel position.
Figure 2A:
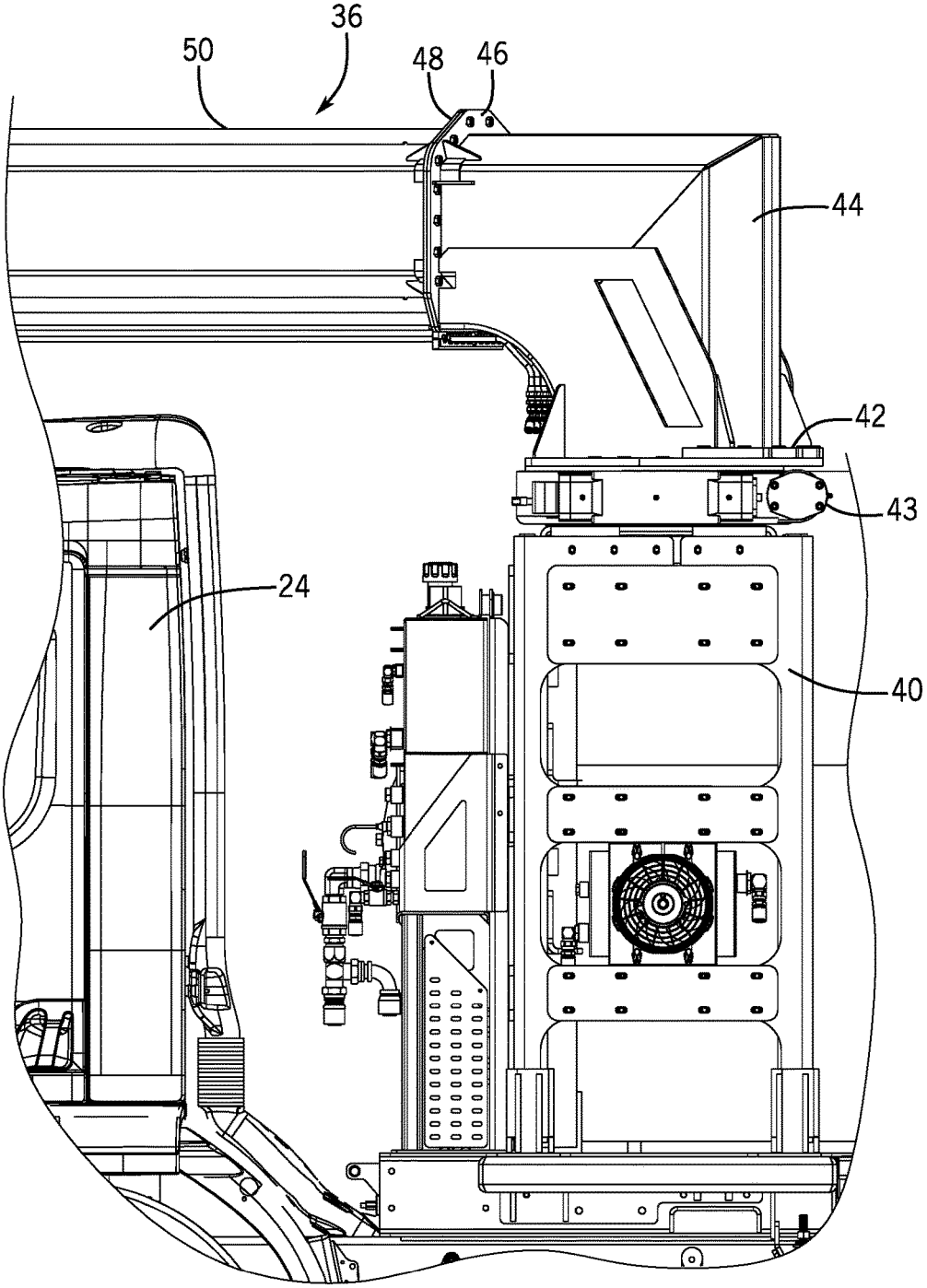
FIG. 2A is a side view of the mounting between the self-supported boom and a turret used to rotate the boom relative to the vehicle chassis.

The blower 32 directs a flow of high velocity air into a self-supported boom 36. The self-supported boom 36 defines an internal airflow passageway to direct the high velocity airflow from the blower 32 out the through a nozzle 38. As illustrated in FIG. 2A, the boom 36 is mounted to the chassis 22 through a support tower 40 mounted behind the cab 24. The support tower 40 supports a turret 42. The boom 36 is mounted to the turret 42 such that the turret 42 can rotate the entire boom 36 as will be described below. Rotation of the turret 42 is controlled by a drive motor 43, which is controlled by the operator located in the cab 24.

As shown in FIG. 2A, a first support elbow 44 of the boom 36 is securely mounted to the turret 42. The first support elbow 44 includes a downstream attachment flange 46 that can be securely connected to a similar attachment flange 48 contained on the top tube 50 though a series of connectors, such as bolt or welding.

Referring back to FIG. 1, the top tube 50 is connected to a front, second elbow 52. The second elbow 52 creates a 90° transition between the top tube 50 and a vertical discharge tube 54. The vertical discharge tube 54 includes the nozzle 38 and is extendable and retractable to modify the distance between the nozzle 38 and ground. Details of the extension and retraction of the vertical discharge tube 54 will be discussed in greater detail below.

Figure 3:
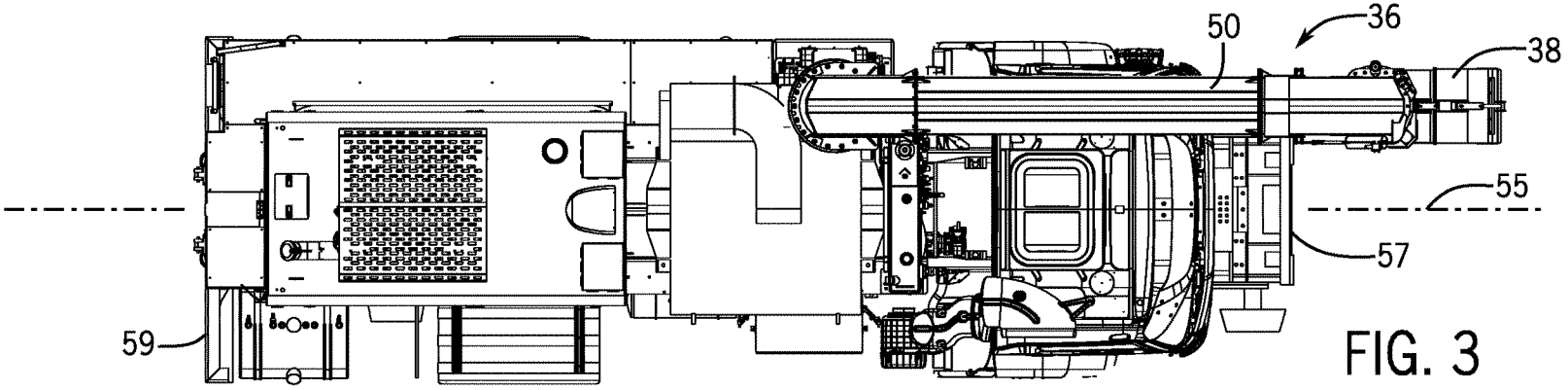
FIG. 3 is a top view of the cold air blower with the self-supported boom in the front facing, operative position.

The self-supporting boom 36 is shown positioned forward from the cab 24 in FIG. 3. In this position, the top tube 50 of the boom 36 is positioned generally parallel to a vehicle axis 55 that extends through the cold air blower from the front end 57 to the rear end 59. The position of the boom 36 relative to the vehicle chassis is monitored through a sensor associated with the rotating turret. Operating components, including a controller contained within the cab 24 of the cold air blower 20, electronically limit the amount of rotation of the self-supporting boom 36 to prevent the nozzle 38 from extending out past the side peripheral edges of the vehicle during normal use. The operating components can include an electronic override that allows the boom 36 to pivot past the edges of the vehicle into a stowed, traveling position shown in FIG. 4. In the stowed, traveling position shown in FIG. 4, the boom 36 is rotated such that the vertical discharge tube 54 and the nozzle 38 are positioned on the right side of the vehicle and behind a transverse vehicle axis 61 that is located at the midpoint of the vehicle between the front end 57 and the rear end 59. When the boom 36 is in this stowed position, the boom 36 is retained by some type of retention mechanism, which may be a bracket (not shown), locking pin, locking chain or any other type of component that can hold the lower end of the boom, including the vertical discharge tube 54 and the nozzle 38, in the transport position illustrated in FIGS. 2 and 4. Unlike prior cold air blowers, the boom 36 can be rotated to this stowed position prior to travel on roadways or airfields, which provides an unobstructed view of the roadway or the pavement surface for an occupant in the cab 24. In prior systems, the boom 36 remained in front of the vehicle, such as shown in FIG. 1, during travel on a roadway.

Figure 4:
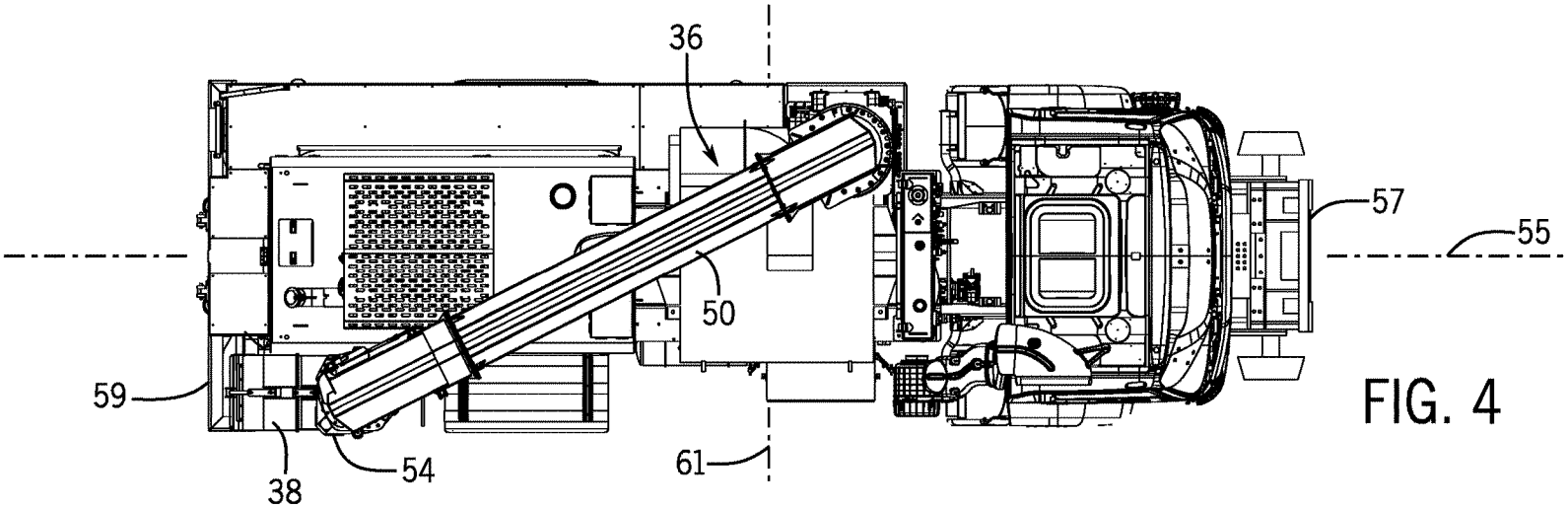
FIG. 4 is a top view of the cold air blower with the self-supported boom in the stowed, travel position.
Figure 5:
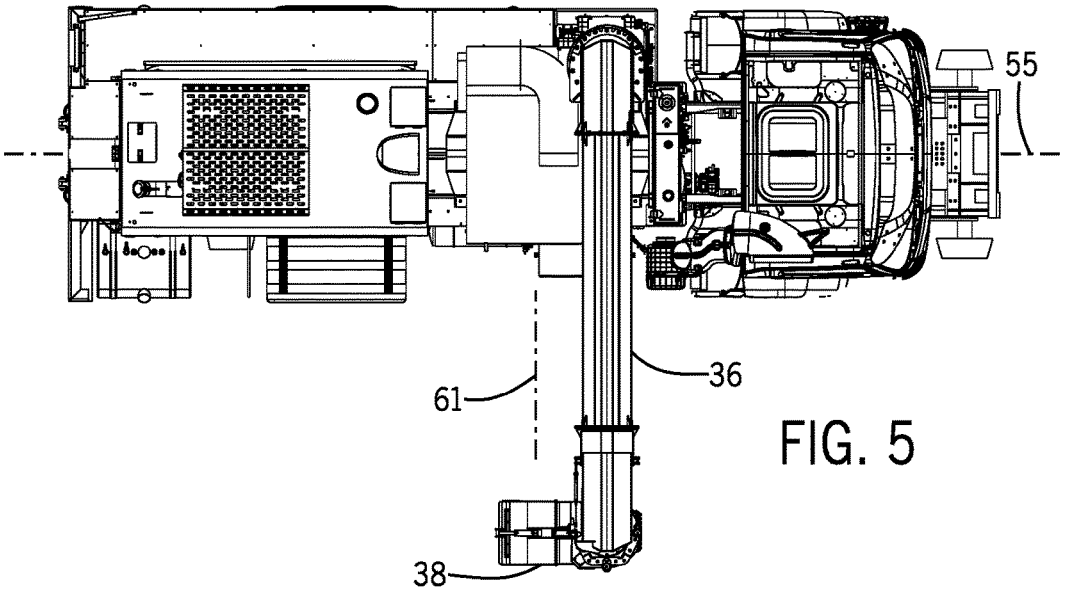
FIG. 5 is a top view showing the self-supported boom in a first transverse operative position.
Figure 6:
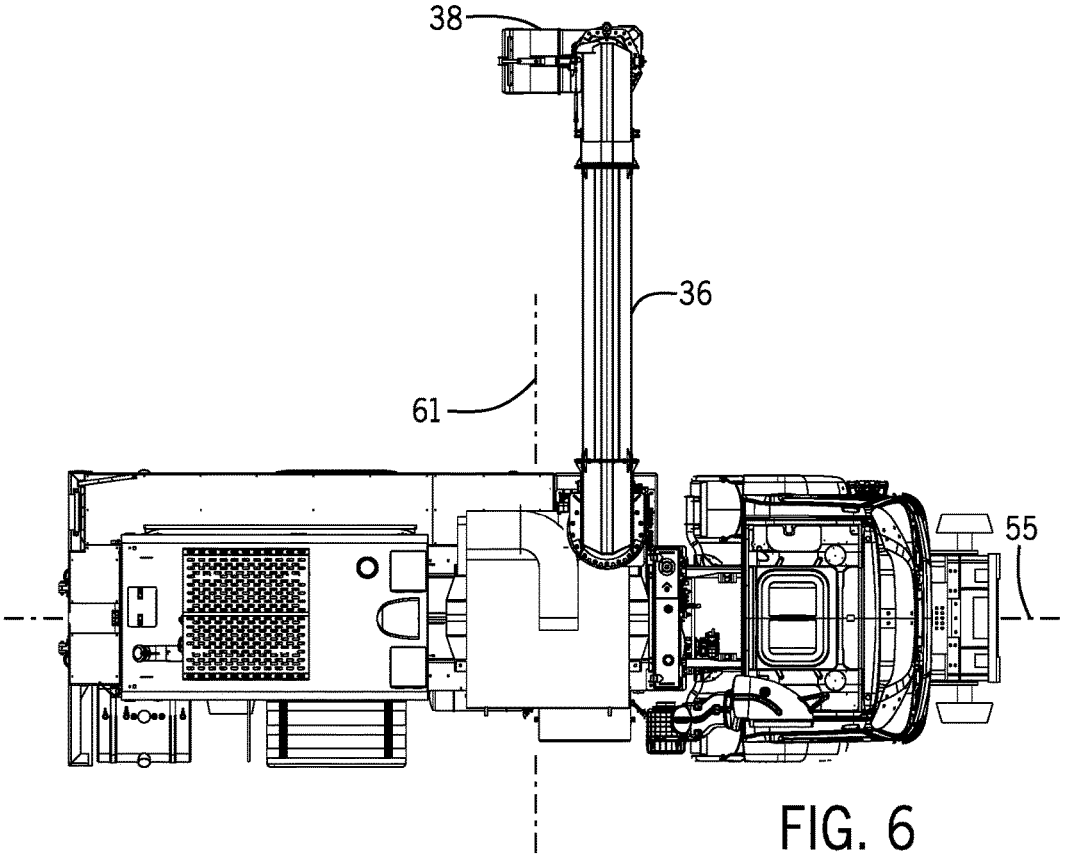
FIG. 6 is a top view showing the self-supported boom in a second transverse operative position, which is 180° rotated from the first transverse operative position of FIG. 5.

FIGS. 3-6 illustrate the movement of the self-supported boom 36 from the front facing forward position shown in FIG. 3 to the stowed, transport position shown in FIG. 4. In addition to these two primary positions, the boom 36 can be moved to multiple other operating positions. FIGS. 5 and 6 illustrate the boom 36 extending perpendicular to the vehicle axis 55 along either the right side of the vehicle (FIG. 5) or transverse to the left side of the vehicle (FIG. 6). In the transverse operating positions shown in FIGS. 5 and 6, the vehicle can drive along the rails to be cleared while the nozzle 38 can be centered along an axis parallel to the direction of vehicle travel to remove snow or debris from the rail line. Similarly, the vehicle can drive along the edge of runways, aprons or taxiways on an airfield while the nozzle 38 can be centered along an axis parallel to the direction of vehicle travel to remove snow, ice or debris from aviation lighting, airfield signage and/or other objects.

Figure 7:
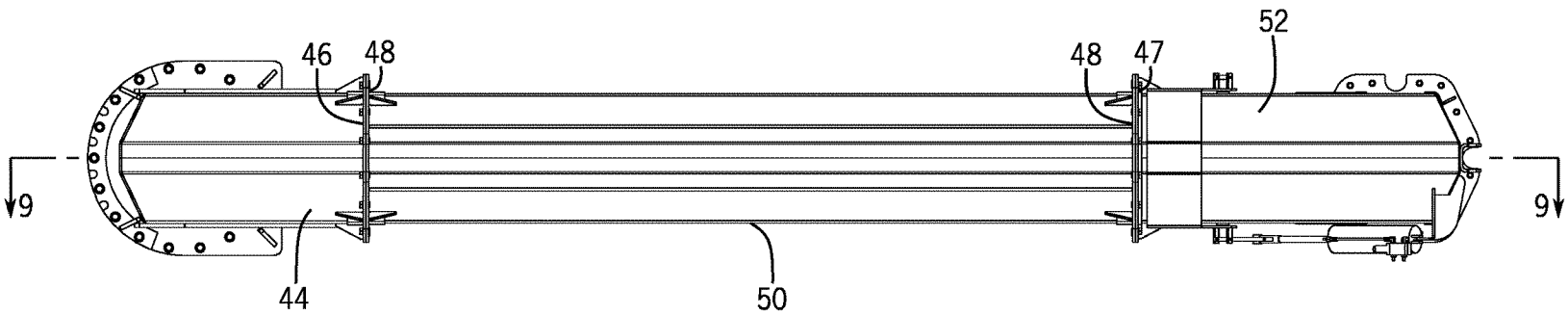
FIG. 7 is a top view of the top tube of the self-supported boom.
Figure 8:
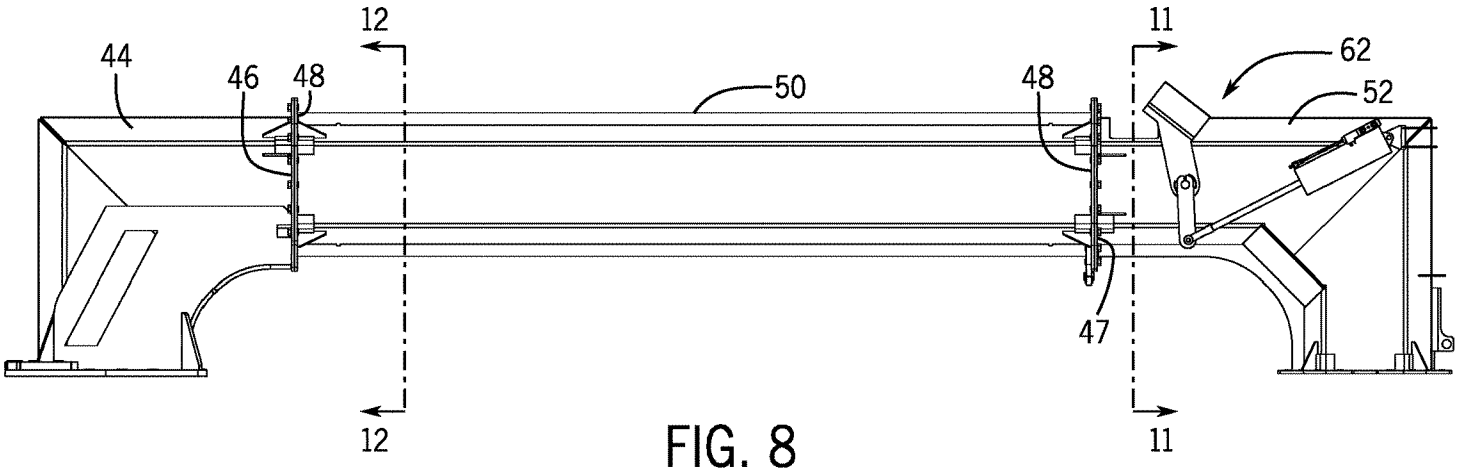
FIG. 8 is a side view of the top tube.
Figure 12:
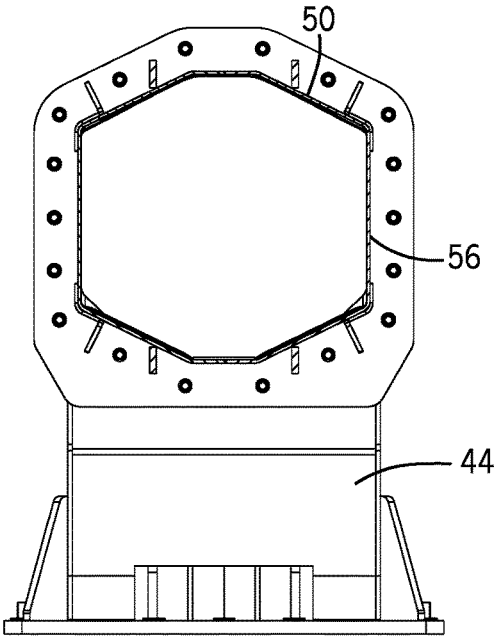
FIG. 12 is a section view taken along line 12-12 of FIG. 8.

FIG. 7 illustrates a top view of the boom 36 while FIG. 8 illustrates a side view of the boom 36. As illustrated, the boom includes the first elbow 44, the top tube 50 and the second, front elbow 52. The first and second elbows 44, 52 are joined to the top tube 50 by a pair of attachment flanges 48 formed on the top tube 50 and corresponding flanges 46, 47 formed on the first and second elbows 44, 52. As illustrated in FIG. 12, the top tube 50 has an octagonal cross-section defined by an outer wall 56. The octagonal shape of the outer wall 56 increases the strength of the top tube without overly increasing the weight.

Figure 9:
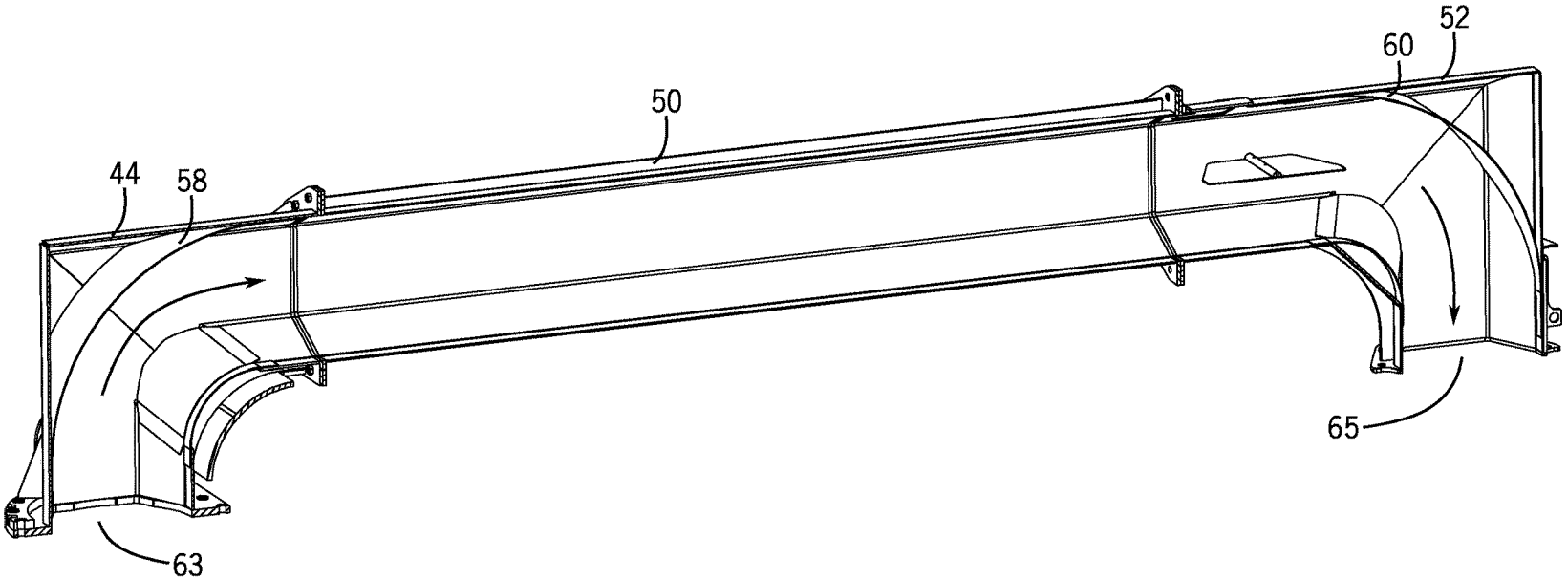
FIG. 9 is a section view taken along line 9-9 of FIG. 7.

Referring to FIG. 9, the first elbow 44 includes a curved flow plate 58 that directs the airflow from the blower from the vertical inlet 63 of the first elbow 44 to the horizontal top tube 50. A similar flow plate 60 directs the airflow from the horizontal top tube 50 to the vertical outlet 65 of the front elbow 52. The pair of flow plates 58, 60 reduces the restriction to the airflow within the boom, which reduces the amount of airflow velocity loss within the top tube 50.

The cold air blower of the present disclosure has been designed to include an air diverter 62 (FIGS. 10A-10C) that can be used to divert the airflow out of the boom 36 before it reaches the nozzle 38, such as when airflow is no longer desired from the nozzle outlet. In prior art systems, when the airflow is diverted away from the nozzle, the drive engine for the blower terminates operation, which results in the need for beginning the startup procedure. The air diverter 62 of the present disclosure diverts the flow of air out through the top of the boom and does not require restarting of the engine.

Figure 10A:
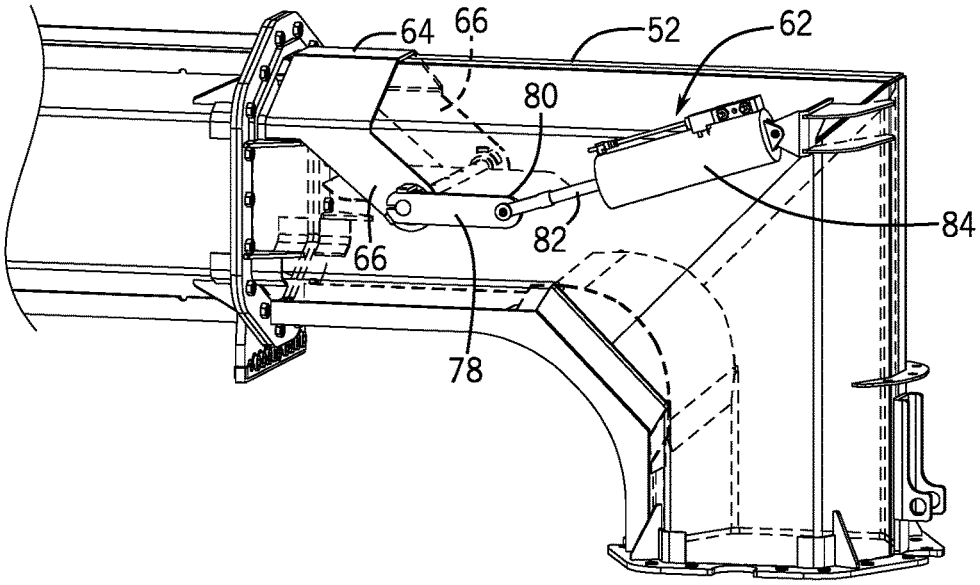
FIG. 10A is a side view of the airflow diverter in a non-diverting position.
Figure 13:
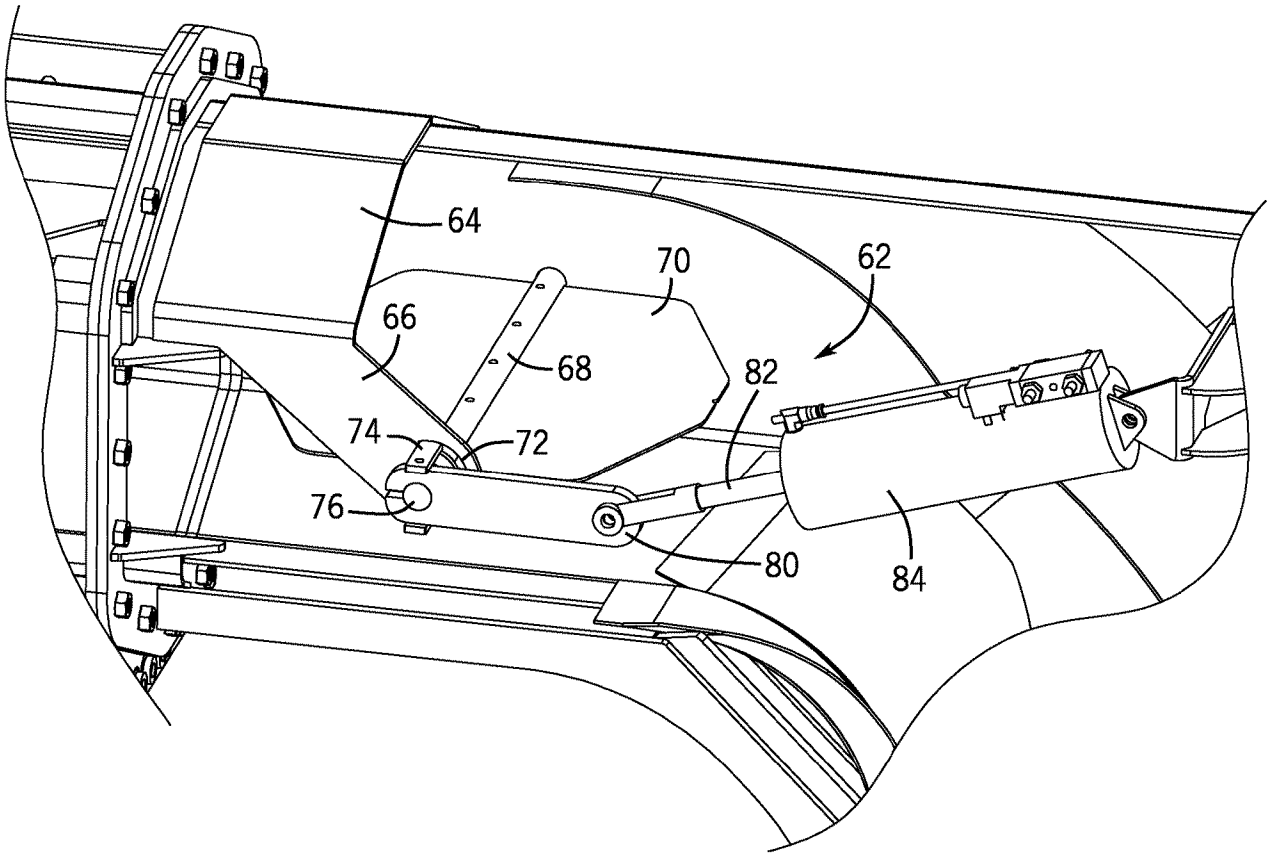
FIG. 13 is a magnified partial section view showing the components of the airflow diverter.

In FIG. 10A, the air diverter 62 is shown in its first, non-diverting position which allows the airflow to move freely from the blower to the nozzle. The air diverter 62 includes a cover plate 64 having a pair of pivot arms 66 positioned on opposite sides of the second elbow 52. As can be seen in the magnified view of FIG. 13, the pivot arm 66 is coupled to a pivot shaft 68. In addition to the cover plate 64, a butterfly valve plate 70 is also securely attached to the pivot shaft 68. The pivot arm 66 includes a slot 72 that receives a pin 74 mounted for rotation with the shaft 68. An outer end 76 of the shaft 68 is securely fixed within an actuator arm 78. A second end 80 of the actuator arm 78 is connector to a rod 82 of the drive cylinder 84.

Figure 10B:
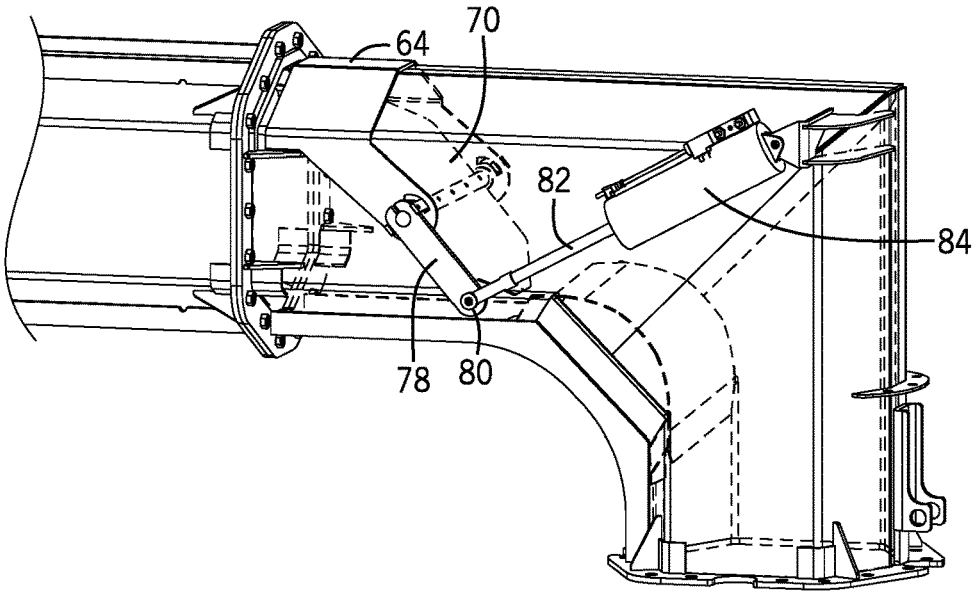
FIG. 10B is a side view of the airflow diverter in the partially rotated position.
Figure 10C:
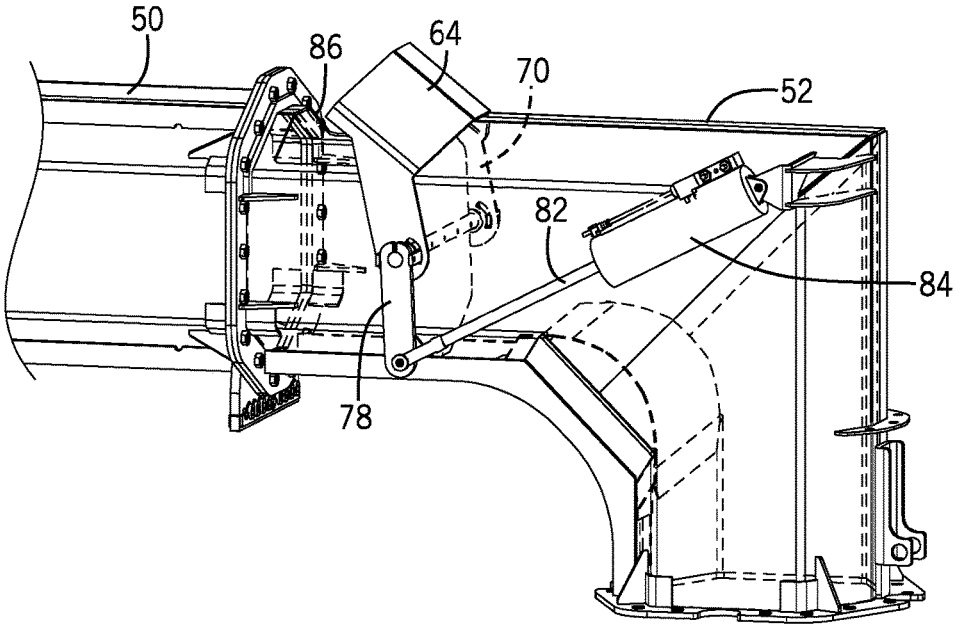
FIG. 10C is a side view of the airflow diverter in a diverting position.
Figure 11:
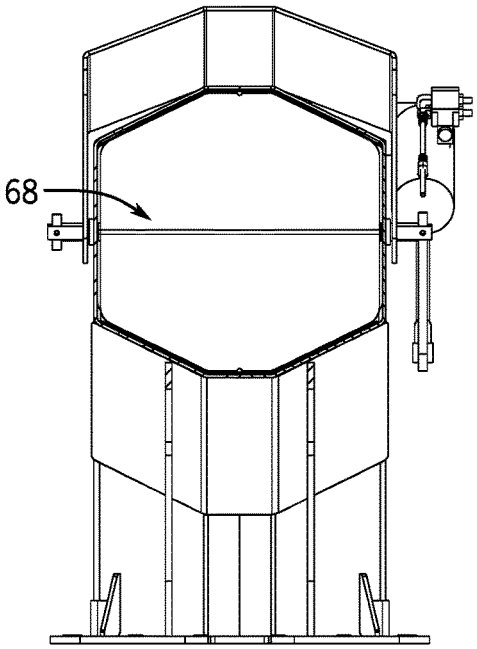
FIG. 11 is a section view taken along line 11-11 of FIG. 8.

When it is desired to divert the airflow away from the nozzle, the drive cylinder 84 is activated though use of controls contained within the cab. When the drive cylinder 84 is activated, the rod 82 is extended, as illustrated in FIG. 10B. During this initial extension, the valve plate 70 rotates 56° from horizontal and the pin 74 moves within the slot 72 until the pin 74 contacts the end of the slot 72. The cover plate 64 only begins to move once the pin 74 reaches the end of the slot 72. As the rod 82 further extends, as shown in FIG. 10C, the actuator arm 78 causes the cover plate 64 to rotate upward, which exposes the opening 86 formed in the top wall of the second elbow 52. When this opening 86 is exposed, the valve plate 70 is in the fully vertical, second position to block the airflow from the blower to prevent the airflow from reaching the nozzle. The entire flow of air is then diverted out of the opening 86 and into the atmosphere. Since the airflow is vented to atmosphere and is thus not restricted, the blower can continue to operate without shutting down the internal combustion drive engine.

Figure 15:
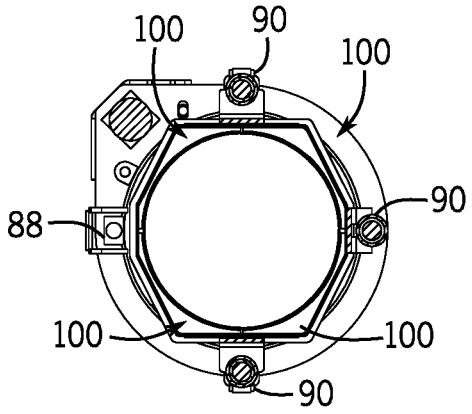
FIG. 15 is a section view taken along line 15-15 of FIG. 18.
Figure 19:
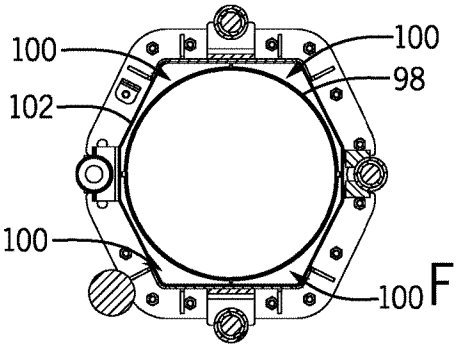
FIG. 19 is a section view taken along line 19-19 of FIG. 18.
Figure 18:
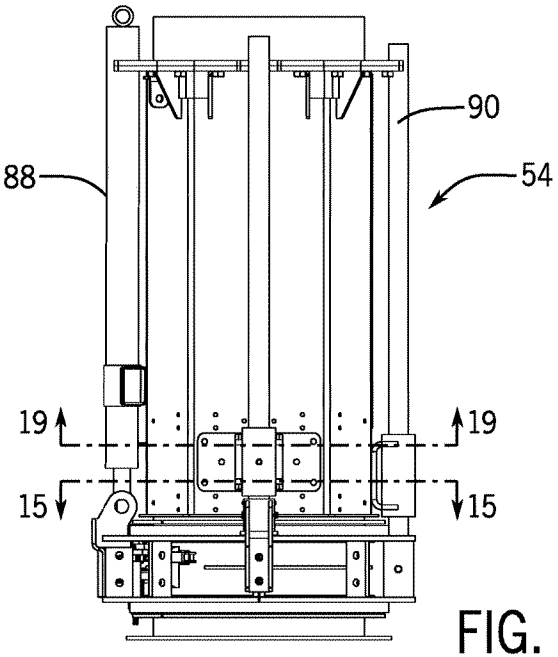
FIG. 18 is a further side view of the vertical discharge tube.
Figure 17:
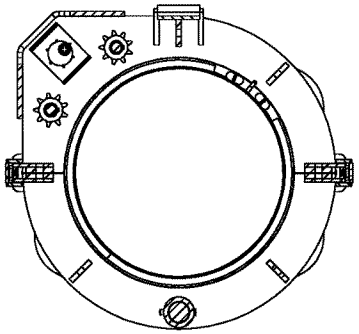
FIG. 17 is a section view taken along line 17-17 of FIG. 16.
Figure 16:
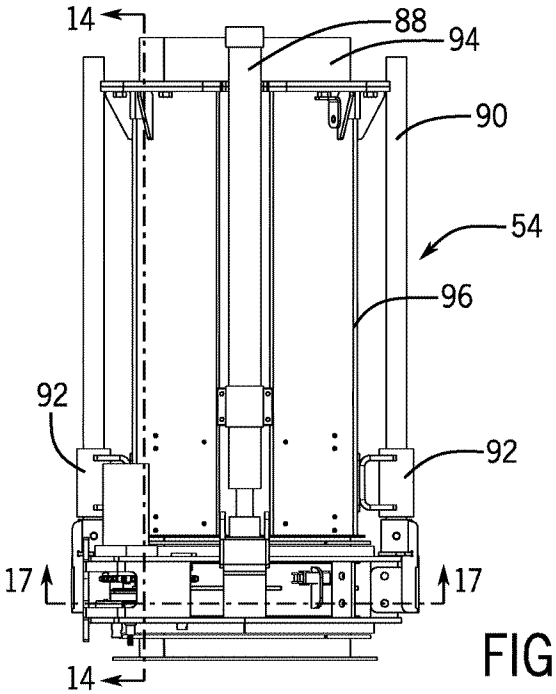
FIG. 16 is a first side view showing the adjustable length vertical discharge tube.

FIGS. 16 and 18 illustrate the adjustment mechanism for adjusting the length of the vertical discharge tube 54. The adjustability of the vertical discharge tube 54 allows the height of the nozzle from the ground to be adjusted by the operator as desired. The vertical discharge tube 54 includes a drive cylinder 88 and a series of spaced guide rods 90. The guide rods 90 each guide the movement of a collar 92 to insure stability during the extension and retraction of the drive cylinder 88. As illustrated in FIG. 15, the single drive cylinder 88 and the three guide rods 90 are offset from each other by 90°. However, a larger number or a fewer number of guide rods 90 could be used while operating within the scope of the present disclosure. As illustrated in FIGS. 16 and 18, the vertical discharge tube 54 includes an inner section 94 and an outer section 96. The vertical discharge tube 54 includes an internal liner 98 which has a circular cross-section, as illustrated in FIG. 19. The internal liner 98 is spaced within the outer wall 102, which has the same octagonal cross section as the top tube. A series of slide adaptors 100 are positioned between the octagonal outer wall 102 and the liner 98.

Figure 14:
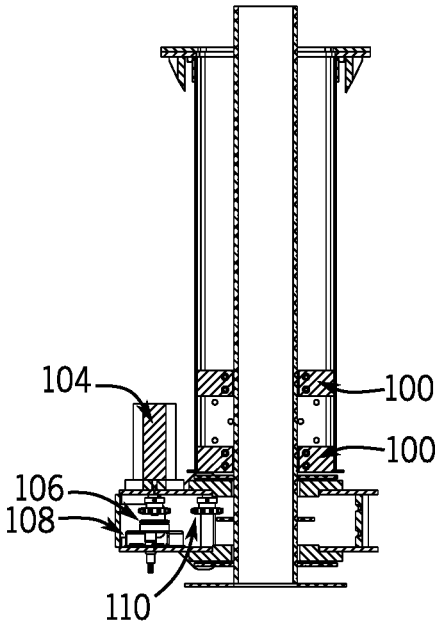
FIG. 14 is a section view taken along line 14-14 of FIG. 16.

FIG. 14 illustrates the components used to change the position of the nozzle relative to the vertical tube. A motor 104 rotates a series of sprockets and such rotation and position is monitored by a steering angle sensor 106 supported by a sensor mount 108. Position signals from the sensor 106 are relayed to a control unit in the cab such that the position of the nozzle can be manually or automatically controlled by the control unit. An idler sprocket 110 is coupled to the drive sprocket to rotate the nozzle.

Figure 20:
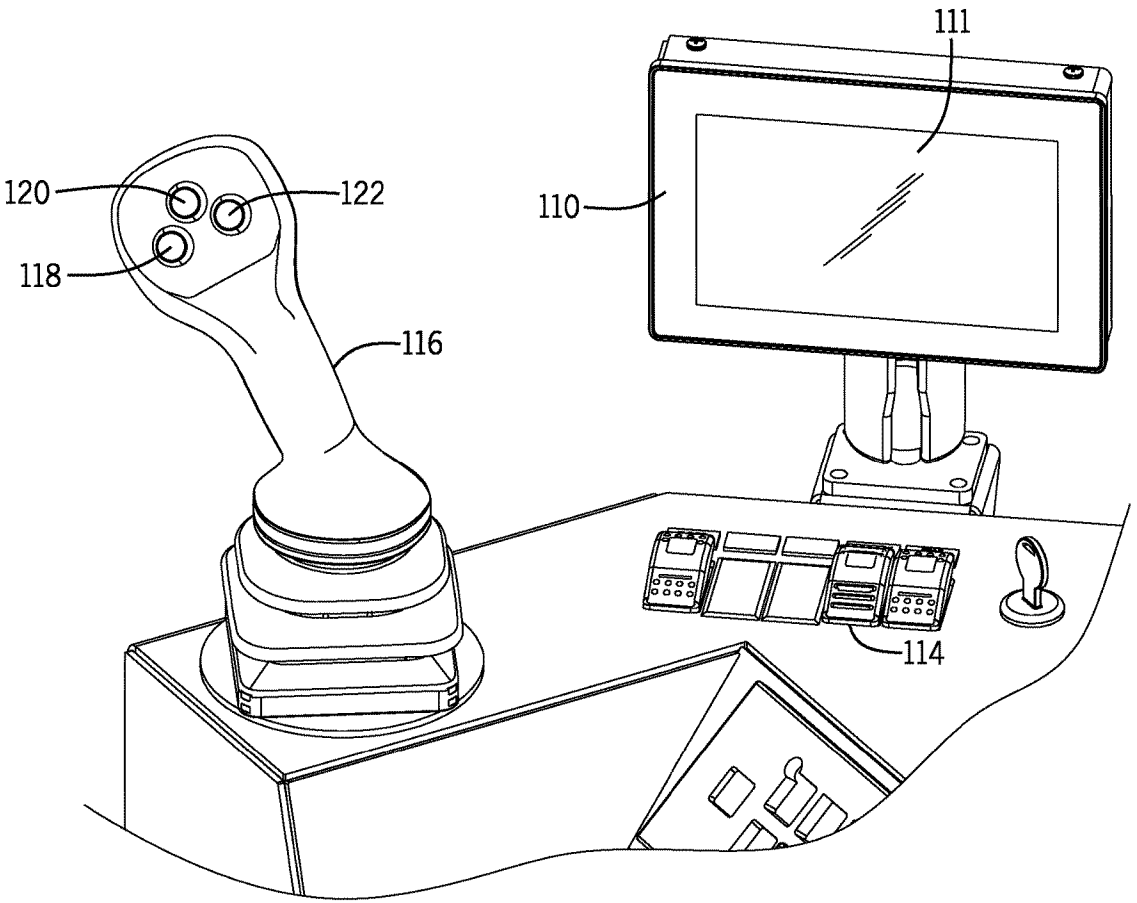
FIG. 20 is a perspective view showing the joy stick used in accordance with the present disclosure.

FIG. 20 illustrates the operating components used within the cab to control movement of the boom both left and right, elevation of the nozzle relative to the ground and rotation of the nozzle relative to the vertical discharge tube. The control system includes a control unit (not shown) that is connected to a display screen 111 which may include a touch panel 112. The display screen is used to display various operating parameters of the cold air blower. In the embodiment illustrated in FIG. 20, a three-position toggle switch 114 is included on the operating panel. The three-position toggle switch 114 allows the operator to switch between three different options for controlling the boom using the joy stick 116. The joy stick 116 includes three function buttons, which in the embodiment illustrated include a green button 118, a blue button 120 and a red button 122. Other colors or types of identifiers could be used, such as different shapes of the buttons or different sizes of the buttons. Depending upon which position the three-position rocker switch is located, when the operator depresses one of the three buttons 118, 120 or 122, the following functions are carried out.

Control Options

Option A
- Green
  - Left/Right—Nozzle Left/Right
  - Up/Down—Nozzle Lift/Lower

Blue
Left/Right—Boom Left/Right
Up/Down—Tip Up/Down
Red
Left/Right—Right: Power Pan 60° Left, Forward, Right; Left: Power Pan 180°
Up/Down—Nozzle Extend/Retract
Option B
Green
Left/Right—Nozzle Left/Right
Up/Down—Tip Up/Down
Blue
Left/Right—Boom Left/Right
Up/Down—Nozzle Lift/Lower
Red
Left/Right—Right: Power Pan 60° Left, Forward, Right; Left: Power Pan 180°
Up/Down—Nozzle Extend/Retract
Option C
Green
Left/Right—Nozzle Left/Right
Up/Down—Tip Up/Down
Blue
Left/Right—Boom Left/Right
Up/Down—Nozzle Extend/Retract
Red
Left/Right—Right: Power Pan 60° Left, Forward, Right; Left: Power Pan 180°
Up/Down—Nozzle Lift/Lower As the above indicates, one option is referred to as the "Power Pan" option. In this operating sequence, the control unit automatically and continuously rotates the nozzle in an automated sequence between a first pan position and a second pan position relative to a vertical rotation axis extending through the vertical discharge tube. In one embodiment of the disclosure, the first and second pan positions are 200 degrees apart. When the system is placed in this mode by the operator, the control unit is able to sweep the nozzle between the two side positions to aid in removing snow and debris. The Power Pan option eliminates the need for the operator to carry out this automatic sequence by manually moving the joy stick.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A cold air blower for removing debris from a ground surface, comprising:

a vehicle chassis having a front end and a rear end and extending along a vehicle axis that extends between the front end and the rear end;

a power unit mounted to the vehicle chassis, the power unit including a blower operable to generate an air flow;

a boom positioned to receive the air flow from the blower and direct the air flow through a nozzle onto the ground surface, wherein the boom is movable between a front position in which the boom is parallel to the vehicle axis and the nozzle is forward of the front end of the vehicle chassis and a stowed position in which the boom is positioned at an angle relative to the vehicle axis and the nozzle is positioned adjacent a side of the vehicle chassis behind a midpoint of the vehicle chassis between the front end and the rear end;

an air flow diverter positioned between the blower and the nozzle, wherein the airflow diverter is operable between a first position to allow the air flow to reach the nozzle and a second position to prevent the air flow from reaching the nozzle; and an elbow having an open flow passageway, the elbow being positioned between the blower and the top tube, wherein the air flow diverter is mounted to the elbow, wherein the flow diverter includes a valve plate mounted within the open flow passageway of the elbow and a cover plate mounted to an outer wall of the elbow where the valve plate is moveable between a first position to allow the air flow to enter the top tube and a second position to prevent the air flow from entering the top tube, wherein the cover plate is moveable between a first position to allow the air flow to enter the top tube and a second position to vent the air flow out of the elbow.

2. The cold air blower of claim 1 further comprising turret positioned between the blower and the boom, wherein the turret is operable to rotate the boom.

3. The cold air blower of claim 1 wherein the boom includes a generally horizontal top tube and a generally vertical discharge tube extending between the top tube and the nozzle, wherein the top tube and the discharge tube each include an open interior to permit the passage of the air flow from the blower to the nozzle.

4. The cold air blower of claim 3 wherein the length of the discharge tube is adjustable.

5. The cold air blower of claim 1 wherein the cover plate and the valve plate are joined to each other by a linkage assembly, wherein the linkage assembly includes an actuator that moves the valve plate before moving the cover plate.

6. The cold air blower of claim 1 wherein the nozzle is secured to the vehicle chassis in the stowed position.

7. The cold air blower of claim 1 wherein the boom is rotatable at least 180 degrees about the turret such that the boom is perpendicular to the vehicle axis on both a first side of the vehicle chassis and a second side of the vehicle chassis.

8. A cold air blower for removing debris from a ground surface, comprising:

a vehicle chassis having a front end and a rear end and extending along a vehicle axis that extends between the front end and the rear end;

a power unit mounted to the vehicle chassis, the power unit including a blower operable to generate an air flow;

a boom positioned to receive the air flow from the blower and direct the air flow through a nozzle onto the ground surface; and a control system operable to automatically and continuously rotate the nozzle about a vertical rotation axis extending through a vertical discharge tube of the boom.

9. The cold air blower of claim 8 wherein the nozzle is rotatable about the vertical discharge tube of the boom over at least 200 degrees of rotation relative to the vertical rotation axis.

10. The cold air blower of claim 9 wherein the control system is operable in a user selectable pan mode to rotate the nozzle between the first and second pan positions.

11. The cold air blower of claim 8 wherein the control system automatically and continuously rotates the nozzle between a first pan position and a second pan position.

12. The cold air blower of claim 8 further comprising an air flow diverter positioned between the blower and the nozzle, wherein the air flow diverter is operable between first position to allow the air flow to reach the nozzle and a second position to prevent the air flow from reaching the nozzle.

13. The cold air blower of claim 8, wherein the boom is movable between a front position in which the boom is parallel to the vehicle axis and the nozzle is forward of the front end of the vehicle chassis and a stowed position in which the boom is positioned at an angle relative to the vehicle axis and the nozzle is positioned behind a midpoint of the vehicle chassis between the front end and the rear end.

14. The cold air blower of claim 8 wherein the boom includes a generally horizontal top tube and a generally vertical discharge tube extending between the top tube and the nozzle, wherein the top tube and the discharge tube each include an open interior to permit the passage of the air flow from the blower to the nozzle.

15. The cold air blower of claim 14 wherein the length of the discharge tube is adjustable.

* * * * *